United States Patent [19]

Mort

[11] 3,977,044

[45] Aug. 31, 1976

[54] HINGE HAVING LOCKED IN PINTLES

[76] Inventor: Edgar A. Mort, 128 College Lane, Poland, Ohio 44514

[22] Filed: Oct. 9, 1975

[21] Appl. No.: 621,228

[52] U.S. Cl. ..... 16/169; 16/176

[51] Int. Cl.[2] ..... E05D 5/12

[58] Field of Search ..... 16/168, 169, 134, 176

[56] References Cited

UNITED STATES PATENTS

| | | | |
|---|---|---|---|
| 2,534,998 | 12/1950 | Steinbach | 16/176 |
| 2,903,735 | 9/1959 | Schneider | 16/176 |
| 3,015,126 | 1/1962 | Ahlgren | 16/168 |
| 3,078,502 | 2/1963 | Nelson | 16/176 |
| 3,216,053 | 11/1965 | Felix | 16/169 X |
| 3,908,227 | 9/1975 | Cain | 16/176 |

*Primary Examiner*—Andrew V. Kundrat

*Attorney, Agent, or Firm*—Webster B. Harpman

[57] ABSTRACT

A hinge plate has an arcuate knuckle which inter-fits with the knuckle joint of a door jamb, the knuckles being secured to each other by a pair of pintles in the hinge knuckle which are urged in opposite directions by a spring and held in movable relation partly within the hinge knuckle by press fit bushings.

4 Claims, 3 Drawing Figures

HINGE HAVING LOCKED IN PINTLES

BACKGROUND OF THE INVENTION

1. Field of the Invention

This invention relates to hinge structures such as used in prehung doors and the like.

2. Description of the Prior Art

Prior structures in the art include hinges having locked in bushings for improved wear with respect to conventional hinge pins as in U.S. Pat. No. 2,869,219. Pintles in hinge knuckles spring urged outwardly thereof are seen in the door hinge structure of U.S. Pat. No. 2,903,735 and variations of the spring and pintle arrangement in hinges may be seen in U.S. Pats. Nos. 3,673,636, 3,671,998 and 2,534,998.

This invention provides the convenience and rapid assembly possible with pre-assembled movable interlocking hinge parts in prehung storm and prime doors and the like.

SUMMARY OF THE INVENTION

A hinge having locked in pintles has a hinge plate with a knuckle along one of its edges and a section of a door jamb having a knuckle along one of its edges with portions thereof cutaway to receive the knuckle portion of the hinge plate. Pintles are positioned in the opposite ends of the knuckle in the hinge plate and urged outwardly thereof by a coil spring positioned between their opposed inner ends. Press fit bushings in the ends of the knuckle lock the pintles and the spring therein with the pintles arranged for longitudinal movement whereby they may be recessed when the knuckle of the hinge plate is engaged in the cutaway area of the door jamb section where they normally act to secure the hinge plate in pivotal relation thereto.

DESCRIPTION OF THE PREFERRED EMBODIMENT

Figure 1:
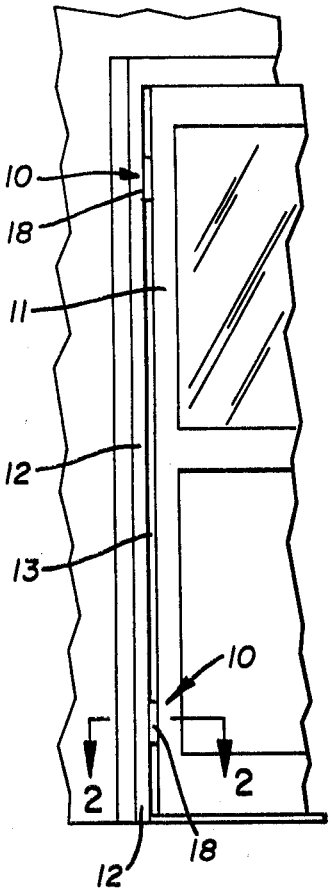
FIG. 1 is a plan view of a portion of a door opening, a door frame therein and a door hinged thereto.

In the form of the invention chosen for illustration herein, the hinge having locked in pintles may be seen in FIG. 1 of the drawings wherein a pair of hinges generally indicated at 10 are attached to a door 11 and comprise part of a continuous vertically standing door jamb 12 which has a knuckle joint formation 13 continously therealong.

Figure 3:
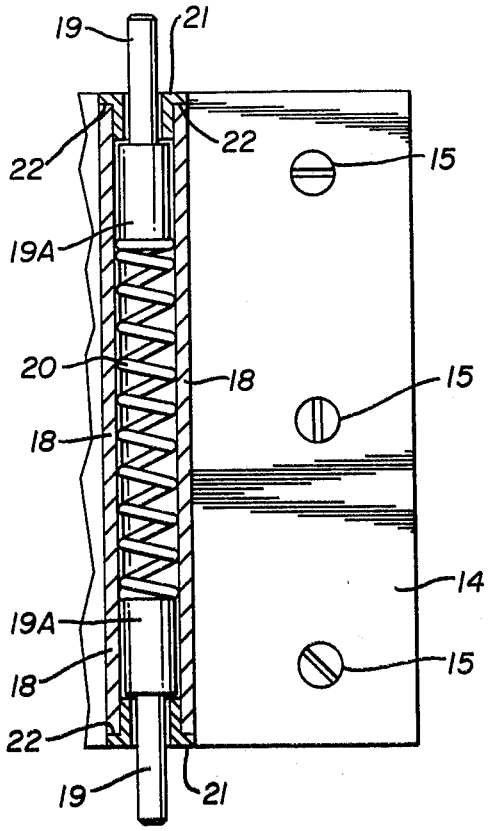
FIG. 3 is a vertical section on line 3—3 of FIG. 2.
Figure 2:
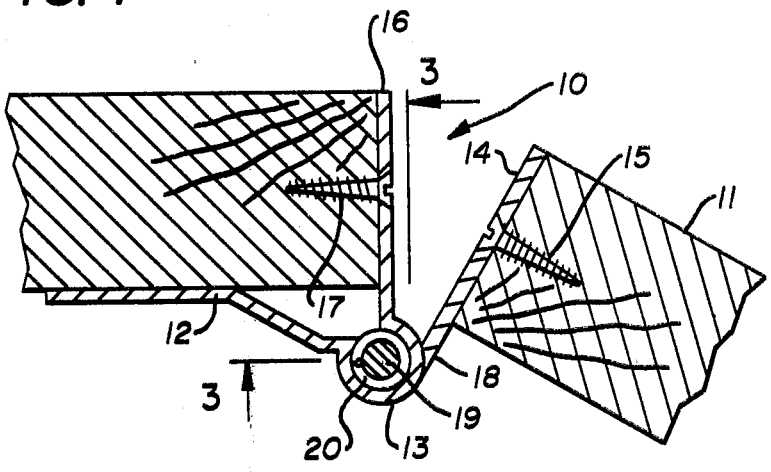
FIG. 2 is a horizontal section in enlarged detail on line 2—2 of FIG. 1.

A hinge plate 14 is secured to the door 11 by fasteners 15 as best seen in FIGS. 2 and 3 of the drawings and in FIG. 2 of the drawings it will be observed that the door jamb 12 has a right angular section 16 through which fasteners 17 are engaged to position the door jamb 12 in a door opening.

Still referring to FIGS. 2 and 3 of the drawings, it will be seen that the hinge plate 14 has a knuckle 18 which is of the same cross sectional configuration as the knuckle joint formation 13 in the door jamb 12 and by referring again to FIG. 1 of the drawings it will be seen that the knuckles 18 are readily positioned in cutaway areas in the knuckle joint formation 13 of the door jamb 12. In order that the knuckles 18 and the hinge plates 14 and the door 11 carried thereby will be retained in desired hinged relation to the door jamb 12, a pair of oppositely disposed pintles 19 and a coil spring 20 located therebetween are positioned in each of the knuckles 18 and retained therein by a pair of oppositely disposed press fit flanged bushings 21.

As best seen in FIG. 3 of the drawings, the flanges of the press fit flanged bushings 21 engage cutaway areas 22 in the knuckle 18 so that their upper and lowermost surfaces as seen in FIG. 3 of the drawings, are flush with the upper and lower surfaces of the hinge plate 14.

Those skilled in the art will observe that the spring 20 and the pintles 19 are positioned in the knuckle 18 and the bushings 21 which have the same exterior diameter as the interior diameter of the knuckle 18 are press fit into the opposite ends of the knuckle 18 so as to retain the pintles 19 and the spring 20 therein. The bushings 21 define axial passageways of a diameter slightly larger than the extending portions of the pintles 19 which are movable relative thereto and the inner ends of the pintles 19 are enlarged as at 19A to provide guiding engagement with the interior of the knuckle 18 and suitable surfaces against which the ends of the coil spring 20 are engaged.

Those skilled in the art will observe that when the hinge with its locked in pintles is positioned in the knuckle joint formation 13 of the door jamb 12, secondary bushings, not shown, are installed in the ends of the knuckle joint formations 13 to receive the extending pintles 19 and provide a suitable long lasting bearing. Such bushings and their conventional installation are illustrated in the aforementioned Pat., No. 2,903,735, and form no part of this invention.

It will thus be seen that a simplified hinge having locked in longitudinally movable pintles has been disclosed which greatly facilitates the assembly of storm doors into mounting frames such as the door jamb frame illustrated and described herein.

Although but one embodiment of the present invention has been illustrated and described, it will be apparent to those skilled in the art that various changes and modifications may be made therein without departing from the spriit of the invention and having thus described my invention what I claim is:

I claim:

1. In a door hinge comprising a hinge plate and a door jamb, knuckles on said hinge plate and door jamb, said knuckles being offset from the planes of the hinge plate and the door jamb, cutaway areas in the knuckle on the door jamb for the reception of the knuckle on the hinge plate, a pair of oppositely disposed pintles, each slidably extending through an end of the bore in said knuckle on the hinge plate, a spring between said pintles urging them apart; each of said pintles having adjacent portions of different large and small diameters, oppositely disposed flanged bushings positioned with a press fit securely within the opposite ends of the knuckle bore on the hinge plate and defining passageways in which the portions of said pintles having said smaller diameters are slidable, said flanged bushings arranged to retain the portions of the pintles having the larger diameters within said knuckle on said hinge plate and provide wearing surfaces therefor.

2. The door hinge set forth in claim 1 and wherein said knuckles on said hinge plate and door jamb are of the same cross sectional configuration.

3. The door hinge set forth in claim 1 and wherein said knuckle on said hinge plate is of a first configuration having an inner diameter slidably receiving the portions of said pintles having the larger diameters and wherein said knuckle on said door jamb is of a second configuration having an inner diameter slidably receiving the smaller diameter portions of said pintles and wherein portions of said pintles extend beyond said flanged bushings in the knuckle on said hinge plate.

4. The door hinge set forth in claim 1 and wherein said knuckle on said hinge plate has cutaway areas at its opposite ends and wherein said flanges of said press fit flanged bushings are positioned in said cutaway areas with their opposite outer surfaces flush with the ends of said hinge plate.

* * * * *